United States Patent [19]

Faudel

[11] 4,401,553

[45] Aug. 30, 1983

[54] SYSTEM AND METHOD FOR LOWERED HYDROGEN SULFIDE EMISSIONS FROM OIL SHALE

[75] Inventor: Gerald B. Faudel, Concorde, Calif.

[73] Assignee: Tosco Corporation, Los Angeles, Calif.

[21] Appl. No.: 418,274

[22] Filed: Sep. 15, 1982

[51] Int. Cl.[3] ..... C10G 1/00; C10B 57/00; C10B 29/00

[52] U.S. Cl. ..... 208/11 R; 208/8 R; 204/158 R; 204/157.1 R; 201/17; 202/105; 202/270

[58] Field of Search ..... 204/158 R, 157.1 R; 208/11 R, 8 R; 201/17; 202/91, 93, 105, 270

[56] References Cited

U.S. PATENT DOCUMENTS

| | | | |
|---|---|---|---|
| 2,243,053 | 5/1941 | Ramage | 204/158 R |
| 3,824,084 | 7/1974 | Dillon et al. | 201/17 |
| 3,960,513 | 6/1976 | Agarwal et al. | 201/17 |
| 4,097,244 | 7/1978 | Burk, Jr. et al. | 201/17 |
| 4,124,467 | 11/1978 | Pincon | 204/157.1 R |
| 4,162,207 | 7/1979 | Boyer et al. | 204/157.1 R |
| 4,177,064 | 12/1979 | Wanzenberg et al. | 208/11 R |
| 4,210,503 | 7/1980 | Confer | 204/158 R |

OTHER PUBLICATIONS

Lowry, Chemistry of Coal Utilization, 1945, p. 430.

*Primary Examiner*—Delbert E. Gantz
*Assistant Examiner*—Chung K. Pak
*Attorney, Agent, or Firm*—Poms, Smith, Lande & Rose

[57] ABSTRACT

Improved process and system for reducing the amounts of hydrogen sulfide emitted during pyrolysis of oil shale. At the elevated temperatures of oil shale pyrolysis, iron pyrite is converted to hydrogen sulfide which is emitted with the product gases and oils. Reduction in hydrogen sulfide emissions is accomplished by treating the oil shale with ultraviolet radiation of a particular wave length prior to pyrolysis in the presence of oxygen to selectively oxidize the pyritic sulfur to sulfate sulfur. The treated oil shale is then retorted at conventional temperatures. The sulfate sulfur does not decompose or otherwise convert to hydrogen sulfide at these temperatures. The sulfate sulfur remains in the spent shale residue and is discarded as waste to thereby effectively reduce the amount of sulfur emitted as hydrogen sulfide in the pyrolysis product gases.

17 Claims, 1 Drawing Figure

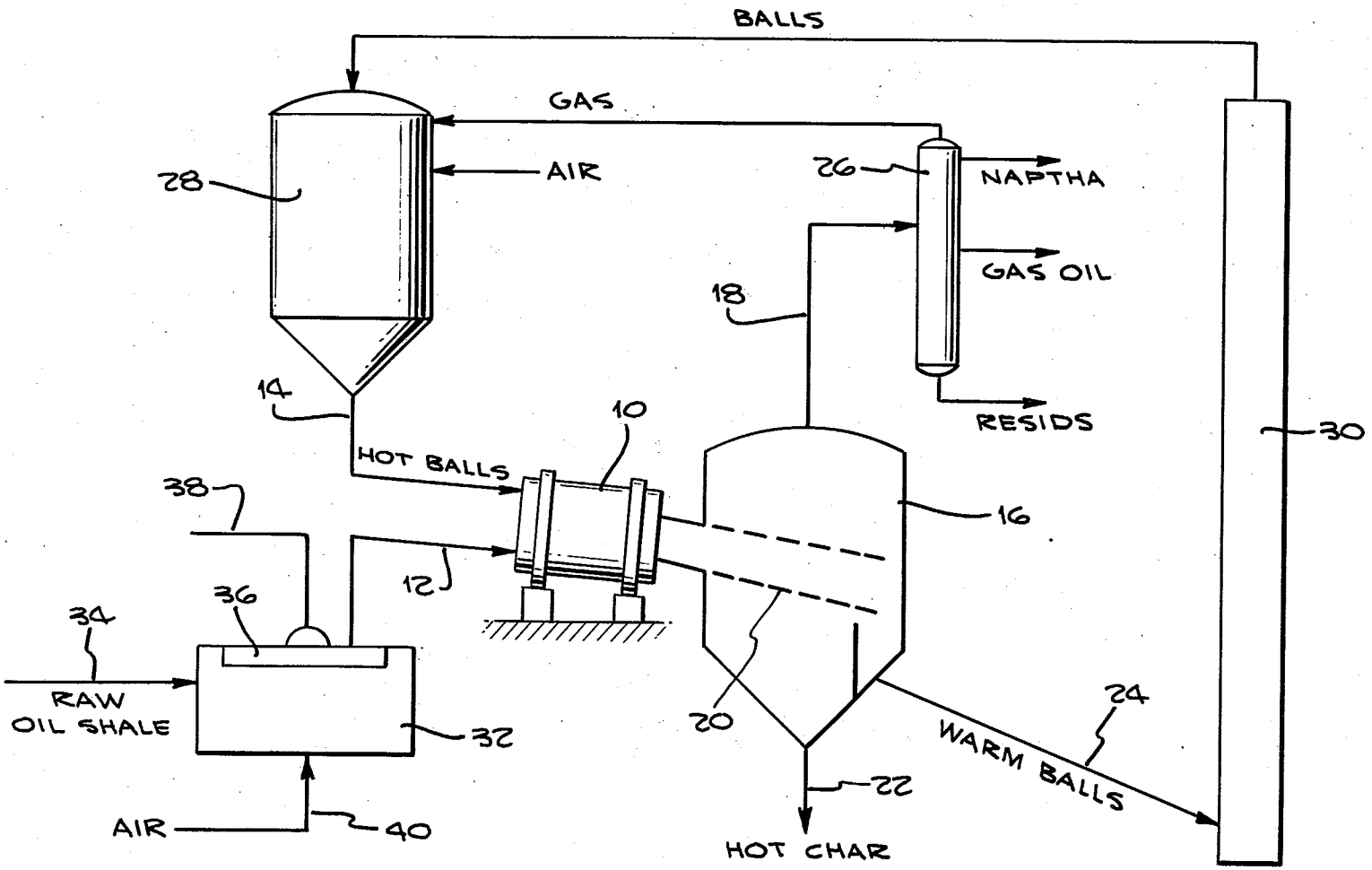
30
BALLS
NAPTHA
GAS OIL
RESIDS
26
18
16
24
WARM BALLS
22
HOT CHAR
20
10
GAS
AIR
28
HOT BALLS
14
12
32
40
38
36
34
RAW OIL SHALE
AIR

SYSTEM AND METHOD FOR LOWERED HYDROGEN SULFIDE EMISSIONS FROM OIL SHALE

BACKGROUND OF THE INVENTION

The present invention relates generally to methods for pyrolyzing carbonaceous material containing pyritic sulfur wherein the pyritic sulfur decomposes at pyrolysis temperatures to form hydrogen sulfide which is emitted with the gases and oil products resulting from the pyrolysis. More specifically, the present invention relates to a system and method for reducing the amount of hydrogen sulfide emitted during pyrolysis of these carbonaceous materials.

Oil shale is a composite material made up of marlstone-type minerals in which the organic polymer kerogen is intimately mixed. Vast reserves of oil shale are present in large areas of Utah, Wyoming and Colorado. Although the extent of these reserves is not definitely known, they have been estimated at being between three and seven trillion barrels. With such vast reserves of oil shale available, it is no wonder that numerous processes have been developed for converting this vast reserve of kerogen into a commercially useful form. As is well known, in order to convert the organic polymer kerogen into commercially useful shale oil, the kerogen must be decomposed and separated from the inorganic or mineral components of oil shale.

The majority of present processes for removing kerogen from oil shale involve heating the oil shale in a reducing atmosphere to pyrolyze the kerogen to form volatile hydrocarbon products. These products are separated from the inorganic portion of the oil shale and recovered by condensation and other conventional procedures.

The mineral or inorganic portion of oil shale includes major amounts of dolomite with lesser amounts of calcite, quartz, illite, albite and microcline also being present. In addition, the mineral portion of the oil shale will include pyrite in quantities ranging up to as much as five percent by weight. Typically however, pyrites are usually present in quantities on the order of one percent by weight. Pyrites are defined as any of the naturally-occuring metal sulfides which include iron disulfide, copper-iron disulfide and tin sulfide. Pyritic sulfur in oil shale is for the most part present as iron disulfide. Iron disulfide may occur in two crystalline forms, pyrite and marcasite.

Conventional oil shale pyrolysis processes involve heating the oil shale in a rotating retort or fluidized bed to temperatures in the range of 800° F. to 1100° F. A reducing atmosphere is maintained within the retort to prevent undesirable oxidation of the released shale oil products. Within the above pyrolysis temperature range, not only does kerogen undergo decomposition and volatilization, but the pyrites present in the oil shale also decompose to form hydrogen sulfide. Hydrogen sulfide is a highly toxic gas which is a well-known by-product formed during treatment of sulfur containing carbonaceous materials. The hydrogen sulfide must be separated from the volatile products and either vented to the atmosphere, converted to a nontoxic form or otherwise processed to form a waste product which may be suitably disposed. Environmental pollution standards strictly limit the amount of hydrogen sulfide which may be vented to the atmosphere, so venting of the toxic gas is not possible. The other alternatives for preventing hydrogen sulfide emissions involve either processing the formed hydrogen sulfide to a nontoxic form or easily disposed non-polluting waste or alternatively preventing the formation of hydrogen sulfide entirely.

U.S. Pat. No. 3,960,513 discloses a process for reducing the amount of sulfur compounds emitted during coal combustion. This method involves converting the pyritic sulfur present in the coal to sulfate sulfur such as iron sulfate or ammonium sulfate. The coal which has been treated to convert pyritic sulfur to sulfate sulfur is then washed with water to dissolve and remove the water soluble sulfate sulfur from the coal. The wet coal is then dried and passed to a power plant for utilization. Although this process provides a technique for removing pyritic sulfur from carbonaceous material, it also includes the undesirable step of having to wash the sulfates from the coal. This produces a wet feed material which must be dried prior to pyrolysis. It would be desirable to provide a process which reduces the amount of pyrites decomposed during pyrolysis and emitted as hydrogen sulfide without the necessity for cumbersome and energy inefficient washing of the material prior to processing.

SUMMARY OF THE INVENTION

The present invention is based on the discovery that sulfur emissions produced during pyrolysis of pyrite contaning carbonaceous materials can be reduced by treating the carbonaceous material to convert pyritic sulfur to sulfate and then pyrolizing the treated material without the necessity of extracting the sulfate sulfur. The present invention is based upon the recognition that at pyrolysis temperatures in the range of 800° F. to 1100° F. sulfate sulfur does not decompose or otherwise react to produce sulfur in a form which may be emitted from the pyrolysis retort. Instead, it has been discovered that sulfate sulfur remains stable and may be conveniently discarded along with other mineral components which remain as pyrolysis residue.

Pyritic sulfur undergoes oxidation to sulfate sulfur according to the following equation:

$$2FeS_2+7O_2+2H_2O \rightarrow 2H_2SO_4+2FeSO_4+62{,}300 \text{ calories}$$

In accordance with the present invention, a system and method is provided which oxidizes pyritic sulfur in pyrolysis feed materials to sulfate sulfur quickly, conveniently and selectively. The present invention is based upon the discovery that pyritic sulfur present in carbonaceous materials selectively absorbs and is excited by ultraviolet radiation resulting in selective oxidation of the pyritic sulfur to sulfate sulfur in the presence of oxygen.

The present invention has application to all carbonaceous materials which contain pyritic sulfur including coals and oil shale. The present invention has particular application to oil shale which typically includes about one percent by weight iron pyrite.

In accordance with the present invention, raw oil shale containing iron pyrite is treated with ultraviolet radiation of a selected wave length prior to pyrolysis. The wave length of the ultraviolet radiation is selected from a range of wave lengths which excite the pyrite molecule resulting in preferential and selective oxidation of the pyrite to mineral sulfate.

As a particular feature of the present invention, the ultraviolet radiation not only excites the pyrite molecules but in addition converts oxygen present in the treatment chamber to ozone which is highly reactive with the pyritic sulfur. The ultraviolet radiation treatment in accordance with the present invention provides an especially well suited technique for converting thermally unstable iron pyrite to the thermally stable iron sulfate. This conversion is accomplished without the need for moisture which further reduces the need for any drying step which may be necessary prior to pyrolysis.

The above discussed and many other features and attendant advantages of the present invention will become apparent as the invention becomes better understood by reference to the following detailed description when considered in conjunction with the accompanying drawings.

BRIEF DESCRIPTION OF THE DRAWING

The FIGURE is a schematic diagram of a conventional pyrolysis system which in addition includes the radiation of raw oil shale in accordance with the present invention.

DETAILED DESCRIPTION OF THE INVENTION

The radiation treatment of the present invention has broad application to the reduction of sulfur emissions produced during high temperature treatment of all of the various carbonaceous materials which contain pyritic sulfur. High temperature treatments of these carbonaceous materials not only includes pyrolysis under reducing conditions to recover product gases and oils, but also includes combustion of the hydrocarbons present in the carbonaceous material under oxidizing conditions to produce heat and energy. Preferably, however, the radiation system and process in accordance with the present invention is utilized in pre-treating carbonaceous materials prior to pyrolysis.

Further, although the present invention is useful in pyrolyzing coal and other carbonaceous materials, it is preferred that the invention be applied to the pyrolysis of oil shale. Accordingly, the following detailed description will be limited to a discussion of the present invention and its application to the treatment of oil shale prior to pyrolysis.

The FIGURE is a diagramatic representation of a conventional oil shale retorting or pyrolysis system which additionally includes means for pretreating the coal in accordance with the present invention. The system includes a rotating retort 10 into which treated oil shale is introduced through line 12. The oil shale is raised to retorting temperatures in the range of 800° F. to 1100° F. by addition to the retort 10 of hot ceramic balls or other heat carrying bodies through line 14. During pyrolysis, kerogen present in the oil shale decomposes to form volatile products with the remainder of the oil shale forming a hot char or residue known as spent shale. The hot char or residue will typically include residual amounts of carbonaceous material on the order of one to five weight percent. The mixture of volatile gases and oils, partially cooled ceramic balls and spent shale is passed from the retort 10 to separator 16. In the separator 16, the volatile products are removed through line 18. The solids blend of spent shale and heat carrying ceramic balls are then separated by way of trommel 20. As is known, the spent shale falls vertically through suitably sized holes or slots in trommel 20 and removed from the bottom of separator 16 through outlet conduit 22. The warm balls do not fall through the holes in trommel 20. The balls instead flow to the end of the trommel 20 where they are collected and removed through outlet 24.

The pyrolysis product vapors are transferred to a suitable condensor or fractionator 26 where they are separated into various fractions including naptha, gas oil and resids. The hot char is passed to further processing for recovery of carbonaceous residues thereon and/or transferred to waste disposal.

The warm balls exiting the separator 16 through line 24 are transferred to ball heater 28 by way of ball elevator or lifter mechanism 30. Combustible gas and air are combusted in the ball heater 28 to provide the heat necessary to reheat the ceramic balls to a temperature in the range of 1200° F. to 1600° F. Preferably combustible gas from fractionator 26 is utilized in the ball heater 28. The balls which have been reheated in the ball heater are then reintroduced into the retort for heating and pyrolysis of oil shale.

The above described system is of course exemplary only and many other conventional pyrolysis systems are known and used with the present invention being equally applicable to them all. For example, the pretreatment process and system in accordance with the present invention may be utilized in conjunction with a fluidized bed retorting or pyrolysis system in which hot shale ash is recycled to the retort to provide the heat necessary for pyrolysis.

The present invention is directed to converting pyritic sulfur present in raw oil shale to sulfate sulfur prior to pyrolysis. In the exemplary embodiment, this irradiation is accomplished in treatment vessel 32. Raw oil shale is introduced through line 34 into the treatment vessel 32. The raw oil shale will typically contain from between zero weight percent to five weight percent pyrite. Although various naturally occuring pyrites, as discussed in the Background of the Invention, may be present in oil shale, iron disulfide or iron pyrite is by far the most prevalent pyrite found in oil shale. Accordingly, the following discussion will be limited to the conversion of pyritic sulfur in the form of iron pyrite to sulfate sulfur in the form of iron sulfate.

As the raw oil shale enters treatment vessel 32, it is subjected to radiation by way of ultraviolet lamp 36. The ultraviolet lamp may be any of the well known conventional lamps and/or devices for generating radiation in the desired ultraviolet wave length. The ultraviolet lamp 36 is connected by way of power line 38 to an appropriate power source. The range of ultraviolet radiation wave length utilized in accordance with the present invention is from between 1800 Å to 3000 Å. More preferably, ultraviolet radiation having a wave length of about 2500 Å is preferred. This wave length range of ultraviolet radiation has been found to excite pyritic sulfur present in the oil shale to increase the rate of oxidation of pyritic sulfur to sulfate sulfur. Oxygen in the form of air or other oxygen containing gas is injected into the treatment vessel 32 through line 40. Sufficient oxygen is maintained within the treatment vessel to provide an oxidizing atmosphere. The wave length range of ultraviolet radiation utilized in the present invention is also produced by the sun. However, this wave length range is absorbed by oxygen in the atmosphere and does not reach the surface of the earth to any appreciable extent. Accordingly, it is desirable to place the ultraviolet radiation generating source as close to the oil shale as physically possible in order to minimize absorption of the radiation energy by the oxygen or air present in the treatment vessel 32.

In addition to exciting pyritic sulfur, the wave length range of ultraviolet radiation in accordance with the present invention also excites oxygen and produces ozone. The combination of excited pyritic sulfur and oxygen results in the fast and selective reaction of these two species to form sulfate sulfur. Any ozone produced by the radiation is highly reactive with the excited pyritic sulfur also resulting in fast and selective oxidation of the pyritic sulfur to sulfate sulfur.

Utilization of ultraviolet radiation which is capable of exciting both pyritic sulfur and oxygen present in the treatment vessel 32 is important since tests in which ozone was electrically generated and contacted with oil shale did not produce conversion of pyritic sulfur to the same extent as when ozone was generated by way of ultraviolet radiation having the wave length range set forth above.

In order to maximize oxidation of the iron pyrite, it is desirable to crush the oil shale prior to introduction to vessel 32. Preferably, the crushed particles of oil shale will have a diameter of ½ inch or less. As the shale particle diameter decreases, the surface area of raw oil shale increases resulting in a proportional increase in surface area treated with radiation and a resultant increase in oxidation. However, it is economically not feasible to crush the oil shale to extremely small particle sizes. Accordingly, particle sizes in the range of 1/16 inch diameter to ½ inch diameter are preferred.

The level of radiation to which the oil shale is subjected may be varied according to oil shale feed rate, pyritic sulfur content and of course the desired degree of conversion of pyritic sulfur to sulfate sulfur. Preferably, the power level of radiation is maintained at a high enough level to convert substantially all of or at least a majority of the pyritic sulfur to sulfate sulfur prior to pyrolysis. For example, radiation power may be increased when residence time within treatment vessel 32 are desired to be kept at a minimum. Alternatively, when lower radiation levels are desired, the residence time in treatment vessel 32 may be increased to achieve the desired conversion of pyritic sulfur to sulfate sulfur. Preferred radiation levels are 100 milliwatts per square centimeter.

A particular feature of the present invention is that the radiation treatment does not require water or moisture. As a result, oil shale which is initially dry on entering the treatment vessel 32 will still be dry after treatment. This is important in shale retorting applications due to the heat requirements necessary for removal of water from the shale prior to retorting. A wet shale cannot effectively be retorted. It must be dried first to prevent the process heat from being used merely for the evaporation of the moisture, rather than for pyrolysis of the oil shale. Although it is desirable that the oil shale be dry when treated to reduce energy losses, it is not necessary that the shale be dried prior to introduction into treatment vessel 32 in order for the radiation treatment to be effective. Accordingly, predried or shale containing minor amounts of moisture may both be treated in accordance with the present invention.

After radiation treatment in vessel 32 the treated oil shale is then passed through line 12 to retort 10 for conventional pyrolysis. At the temperatures of conventional pyrolysis, the sulfate sulfur produced in treatment vessel 32 does not undergo decomposition or other reaction to produce hydrogen sulfide. The sulfate sulfur remains in the solids residue of spent shale and is subsequently disposed of by removal through outlet 22. This process effectively prevents sulfur present as iron pyrite from being converted to hydrogen sulfide and being emitted as an undesirable toxic by-product. Further, this sulfur emission reduction is accomplished by a quick, convenient and selective conversion of pyritic sulfur to sulfate sulfur without the need for slower oxidation utilizing moisture.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein.

What is claimed is:

1. In a process for pyrolyzing carbonaceous material containing pyritic sulfur at a temperature at which said pyritic sulfur forms hydrogen sulfide which is emitted with the pyrolysis product gases and oils, wherein the improvement comprises reducing the formation of hydrogen sulfide by treating said carbonaceous material prior to pyrolysis with ultraviolet radiation in the presence of oxygen for a sufficient time to convert said pyritic sulfur to sulfate sulfur to form treated carbonaceous material and pyrolyzing the treated carbonaceous material wherein said sulfate sulfur does not form hydrogen sulfide at said pyrolysis temperature thereby reducing the amount of hydrogen sulfide emitted with said pyrolysis products.

2. The improvement according to claim 1 wherein said carbonaceous material is oil shale.

3. The improvement according to claim 1 wherein said ultraviolet radiation has a wavelength of between about 1800 Å and 3000 Å.

4. The improvement according to claim 3 wherein said ultraviolet radiation has a wavelength of about 2500 Å.

5. The improvement according to claim 2 wherein said oil shale is crushed prior to treatment to form oil shale particles having diameters below ½ inch.

6. The improvement according to claim 3 wherein said particle diameters are greater than 1/16 inch.

7. The improvement according to claim 2 wherein said pyrolysis is carried out at about 900° F.

8. The improvement according to claim 1 wherein substantially all of said pyritic sulfur is converted to sulfate sulfur.

9. A process for reducing hydrogen sulfide emissions resulting fom pyritic sulfur decompostion during high temperature treatment of carbonaceous material containing pyritic sulfur comprising:

treating said carbonaceous material with ultraviolet radiation in the presence of oxygen for a sufficient amount of time to convert said pyritic sulfur to sulfate sulfur to form treated carbonaceous material;

heating said carbonaceous material containing sulfate sulfur to a temperature above the decomposition temperature of pyritic sulfur, but below the decomposition temperature of said sulfate sulfur whereby the level of hydrogen sulfide emissions is reduced.

10. The process according to claim 9 wherein said ultraviolet radiation has a wavelength of between about 1800 A and 3000 A.

11. The process according to claim 10 wherein said carbonaceous material is oil shale.

12. The process according to claim 9 wherein said heating of carbonaceous material is carried out in a reducing atmosphere to produce product gases and oils.

13. A system for lowering hydrogen sulfide emissions from a retort during pyrolsis of sulfur containing carbonaceous material comprising:

a radiation vessel defining a radiation zone;

inlet means for introducing untreated pyritic sulfur containing carbonaceous material into said radiation zone;

oxygen inlet means for introducing oxygen containing gas into said radiation zone;

radiation means for exposing said untreated carbonaceous material to ultra-violet radiation having a wavelength which converts said pyritic sulfur to sulfate sulfur in the presence of oxygen to form treated carbonaceous material containing said sulfate sulfur;

outlet means for removing said treated carbonaceous material from said radiation zone;

retort means for pyrolyzing said treated carbonaceous material at a temperature above the decomposition temperature of pyrite, but below the decomposition temperature of sulfate sulfur whereby said sulfate sulfur remains in the pyrolysis residue and is not emitted from the retort as hydrogen sulfide; and means for transferring said carbonaceous material from said outlet means to said retort means.

14. A system according to claim 13 wherein said radiation means includes a radiation source which emits radiation having a wavelength in the range of 1800 Å to 3000 Å.

15. A system according to claim 14 wherein said radiation source is placed as close to said carbonaceous material as possible to reduce absorption of said radiation by oxygen present in said radiation vessel.

16. In a system for treating carbonaceous materials containing pyritic sulfur at temperatures at which said pyritic sulfur decomposes to form vaporous sulfur which is emitted from said system, wherein the improvement comprises;

means for treating said carbonaceous material prior to said high temperature with ultraviolet radiation in the presence of oxygen for a sufficient time to convert said pyritic sulfur to sulfate sulfur which does not decompose during high temperature treatment whereby the amount of vaporous sulfur emitted is reduced.

17. An improved system according to claim 16 wherein said means for treating carbonaceous material with radiation includes an ultraviolet radiation source capable of generating ultraviolet radiation having a wavelength of between about 1800 Å and 3000 Å.

* * * * *